US010625826B2

(12) United States Patent
Zimmerman

(10) Patent No.: US 10,625,826 B2
(45) Date of Patent: Apr. 21, 2020

(54) MOTORIZED SWIVELING WATERSPORTS EQUIPMENT RACK

(71) Applicant: LeClaire Manufacturing Company, Bettendorf, IA (US)

(72) Inventor: Michael Zimmerman, Kansas City, MO (US)

(73) Assignee: LeClaire Manufacturing Company, Bettendorf, IA (US)

( * ) Notice: Subject to any disclaimer, the term of this patent is extended or adjusted under 35 U.S.C. 154(b) by 0 days.

(21) Appl. No.: 16/020,744

(22) Filed: Jun. 27, 2018

(65) Prior Publication Data

US 2018/0304975 A1 Oct. 25, 2018

Related U.S. Application Data

(63) Continuation of application No. 15/193,817, filed on Jun. 27, 2016, now Pat. No. 10,040,516.

(51) Int. Cl.

| | |
|---|---|
| ***B63B 35/85*** | (2006.01) |
| ***B63B 25/00*** | (2006.01) |
| ***B63B 35/79*** | (2006.01) |

(52) U.S. Cl.

CPC ..... *B63B 25/002* (2013.01); *B63B 35/7946* (2013.01)

(58) Field of Classification Search

CPC ..... B63B 27/36; B63B 27/16; B63B 35/7946; B63B 35/85; B63B 2017/0054; B63B 25/00; A01K 97/10

See application file for complete search history.

(56) References Cited

U.S. PATENT DOCUMENTS

| | | | | |
|---|---|---|---|---|
| 4,708,670 | A | 11/1987 | Peters | |
| 4,838,818 | A | 6/1989 | Edwards | |
| 5,788,133 | A | 8/1998 | Mareno | |
| 6,027,103 | A * | 2/2000 | Painter | B66D 1/12 254/332 |
| 6,369,542 | B1 | 4/2002 | Knight | |
| 8,800,461 | B2 | 8/2014 | James | |
| 8,905,281 | B2 | 12/2014 | Jesewitz | |
| 9,038,875 | B2 | 5/2015 | Jesewitz | |

(Continued)

OTHER PUBLICATIONS

International Search Report and Written Opinion, PCT/US17/31954 (dated Jun. 30, 2017).

*Primary Examiner* — Andrew Polay
(74) *Attorney, Agent, or Firm* — Goodhue, Coleman & Owens, P.C.

(57) ABSTRACT

A motorized water sports equipment rack and method for motorized swiveling of a water sports equipment rack attached to a boat are disclosed. The motorized water sports equipment rack includes a mounting bracket for securing the mounting bracket to the boat and a water sports rack mounting bolt connected to the mounting bracket. A swivel bracket is connected to the water sports rack mounting bracket. A water sports equipment rack mount is connected to the swivel bracket. The water sports equipment rack mount supports a water sports equipment rack adapted for holding various types of water sporting equipment. A sealed actuator housing is connected to the swivel bracket and houses an actuator, such as an electric, pneumatic or hydraulic actuator. The actuator is configured to drive the swivel bracket to rotate the water sports equipment rack.

20 Claims, 7 Drawing Sheets

(56) References Cited

U.S. PATENT DOCUMENTS

| | | | |
|---|---|---|---|
| 9,045,090 | B2 | 6/2015 | Wilhelm |
| 9,055,826 | B2 | 6/2015 | Curts et al. |
| 2007/0209567 | A1 | 9/2007 | Fee et al. |

* cited by examiner

MOTORIZED SWIVELING WATERSPORTS EQUIPMENT RACK

PRIORITY STATEMENT

This application is a continuation of U.S. patent application Ser. No. 15/193,817, filed Jun. 27, 2016, hereby incorporated by reference in its entirety.

FIELD OF THE INVENTION

The present invention relates to boating and water sports. More particularly, but not exclusively, the present invention relates to a motorized water sports equipment rack affixed to a boat.

BACKGROUND

With the increase in the number and type of water sports equipment and accessories brought aboard and stowed on a boat, boaters continue to look for viable alternatives to stow water sports equipment and accessories in such a way that they are conveniently and readily accessible yet still positionable out of the way to not hinder a boater's safe operation of, care for and ultimate enjoyment of the boat. Current equipment racks fail to adequately provide a solution that addresses the safety of the boat and its operation, the occupants within and around the boat, the surroundings of the boat both within and out of the water, and the water sports equipment stowed aboard the boat. Therefore, what is needed is a motorized swiveling watersports equipment rack that addresses each of the shortcomings with current water sports equipment racks.

SUMMARY

Therefore, it is a primary object, feature, or advantage of the present invention to improve over the state of the art.

It is a further object, feature, or advantage of the present invention to provide push-button automation to a motorized swiveling watersports equipment rack.

It is a still further object, feature, or advantage of the present invention to provide the captain of a boat with the ability to automatically operate one or more motorized swiveling watersports equipment racks without having to leave the helm thereby increasing the safe operation of the boat.

Another object, feature, or advantage is to provide remote, controller-type, motored automation of the swiveling movement of a water sports equipment rack to minimize a boater's physical contact with and possibility for suffering harm from any moving components of the water sports equipment rack.

Yet another object, feature, or advantage is to provide an automated and motorized swiveling watersports equipment rack wherein the actuator is enclosed within a housing protected from the corrosive and damaging marine environment.

Still another object, feature, or advantage is to provide a motorized water sports equipment rack for a boat. The motorized water sports equipment rack includes a mounting bracket having one or more mounting points for securing the mounting bracket to the boat and a water sports rack mounting bracket having a mounting end connected to the mounting bracket and a swivel bracket supporting end. A swivel bracket is connected to the swivel bracket supporting end of the water sports rack mounting bracket whereby the swivel bracket rotates about the water sports rack mounting bracket. A water sports equipment rack mount is connected to the swivel bracket. The water sports equipment rack mount is configured to support a water sports equipment rack adapted for holding one or more types of water sporting equipment. In a preferred form, a sealed actuator housing is connected to the swivel bracket and an actuator is housed within the sealed actuator housing. A drive shaft is connected between the actuator and the water sports rack mounting bracket. The actuator is configured to drive the swivel bracket to rotate the swivel bracket, the water sports equipment rack mount and the water sports equipment rack.

A further object, feature, or advantage is to provide a boat with a helm, a hull having structural portions including at least a bow, a stern, and starboard and port sides, and a motorized water sports equipment rack for holding one or more types of water sporting equipment on the boat. The motorized water sports equipment rack can include a mounting bracket having one or more mounting points for securing the mounting bracket to the boat and a water sports rack mounting bracket having a mounting end connected to the mounting bracket and a swivel bracket supporting end. A swivel bracket is connected to the swivel bracket supporting end of the water sports rack mounting bracket so that the swivel bracket rotates about the water sports rack mounting bracket. A rack mount is connected to the swivel bracket. The rack mount is configured to support a water sports equipment rack adapted for holding different types of water sporting equipment. In a preferred form, a sealed motor housing is connected to the swivel bracket and a motor is housed within the sealed motor housing. A drive shaft is connected between the motor and the water sports rack mounting bracket so that the motor by controller operation drives the swivel bracket to rotate the swivel bracket, the rack mount and the water sports equipment rack.

Other objects, features, or advantages provide a method for motorized swiveling of a water sports equipment rack attached to a boat by providing a sealed motor housing, an electric motor housed within the sealed motor housing, and a drive shaft operatively connected between the electric motor housing and a rack mounting bolt. In a preferred aspect, one or more mounting points of a mounting bracket are secured to the boat and a mounting end of the rack mounting bolt is attached to the mounting bracket. A swivel bracket is attached to the swivel bracket supporting ends of the rack mounting bolt. The electric motor rotates a rack mount operatively connected to the swivel bracket by rotating the swivel bracket about the rack mounting bolt. The rack mount is configured to support the water sports equipment rack, which is designed for holding various types of water sporting equipment.

One or more of these and/or other objects, features, or advantages of the present invention will become apparent from the specification and claims that follow. No single embodiment need provide each and every object, feature, or advantage. Different embodiments may have different objects, features, or advantages. Therefore, the present invention is not to be limited to or by an objects, features, or advantages stated herein.

BRIEF DESCRIPTION OF THE DRAWINGS

Illustrated embodiments of the disclosure are described in detail below with reference to the attached drawing figures, which are incorporated by reference herein, and where.

DETAILED DESCRIPTION

An automatic swiveling, motorized watersports equipment rack is described which may be used to store surf boards, water skis, wakeboards, and other water sports equipment on a boat. The rack is automatic in that an actuator, such as an electric, hydraulic or pneumatic motor is housed within the device and upon actuation by a controller the rack travels in a swiveling movement between a position inside the boat (an "in" position) and a position outside the boat (an "out" position) to stow water sports equipment and accessories in such a way that they are conveniently and readily accessible yet still positionable out of the way to not hinder a boaters safe operation of, care for and ultimate enjoyment of the boat. With an actuator being housed within the fittings of the rack hinge itself, both precious space aboard the boat is saved and the electrical components are protected from the moist and often harsh marine environment.

Figure 1:
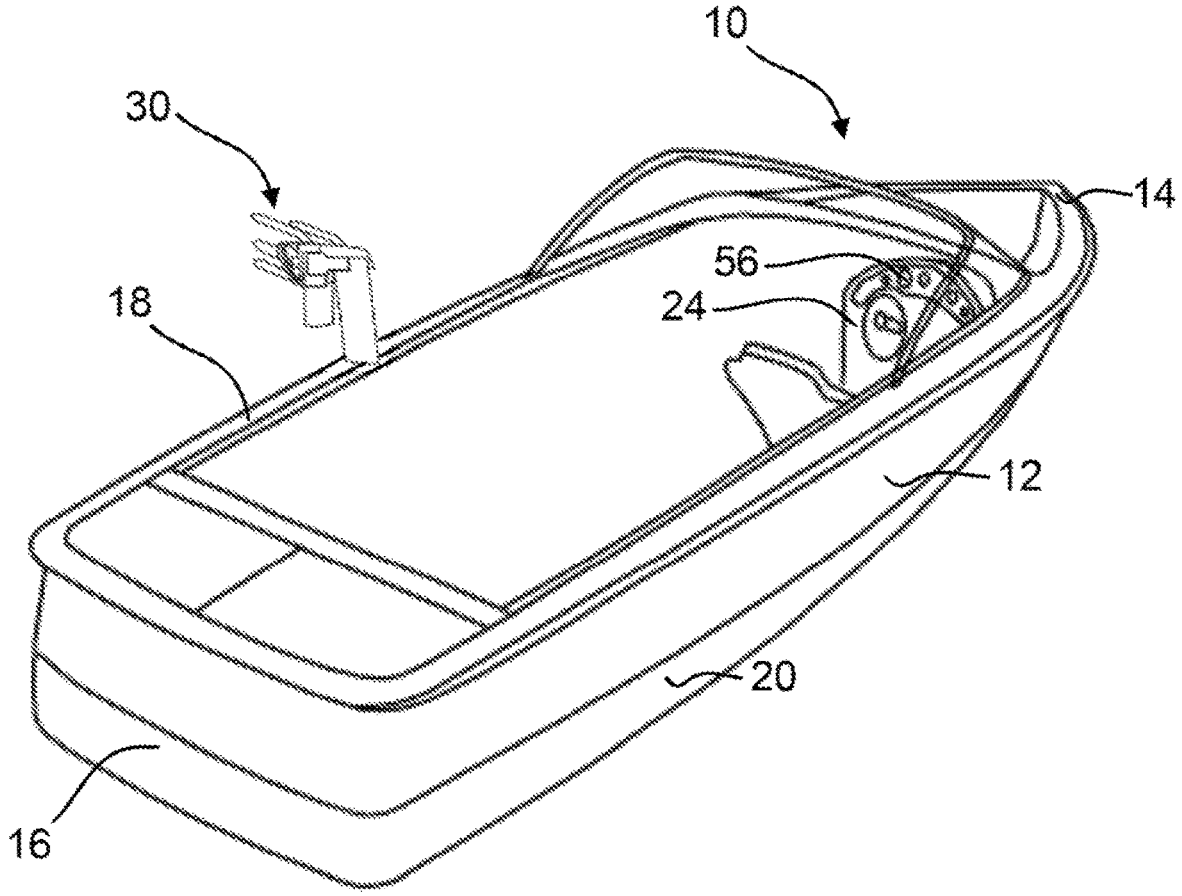
FIG. 1 is a pictorial representation of a boat with the motorized swiveling water sports equipment rack in accordance with an illustrative embodiment of the invention.
Figure 2:
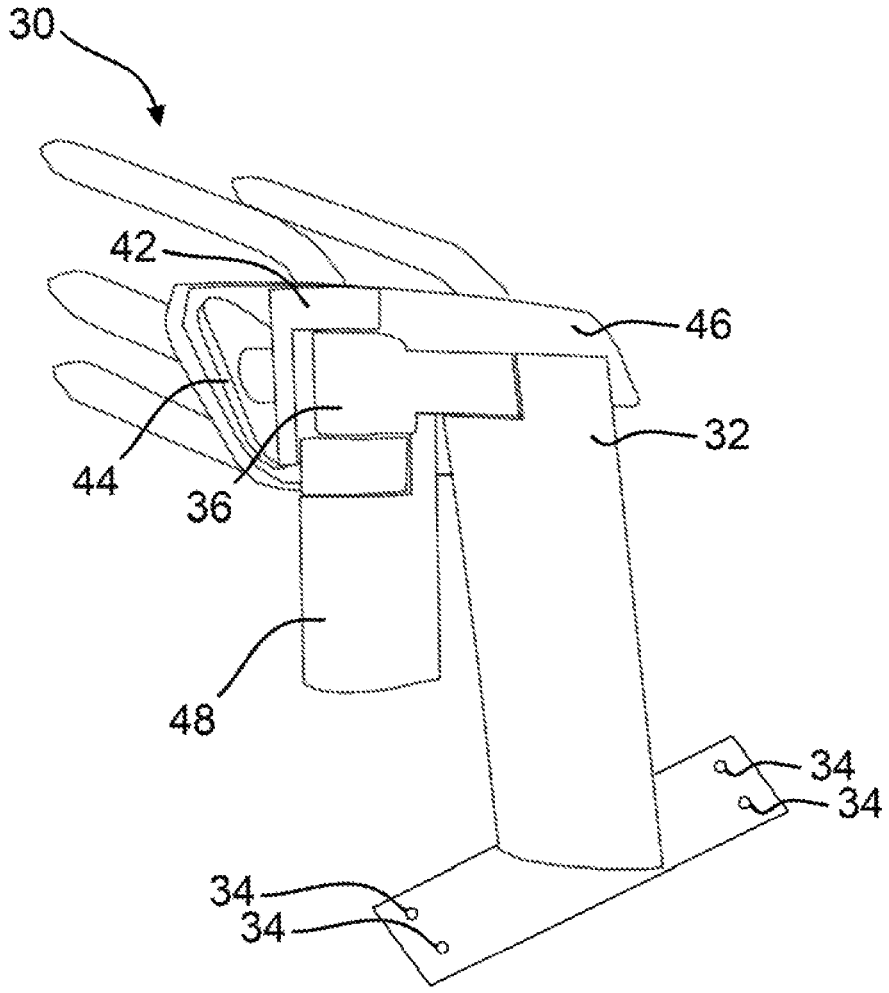
FIG. 2 is a pictorial representation showing a close-up view for an operating position of the motorized swiveling water sports equipment rack in accordance with an illustrative embodiment of the invention.
Figure 3:
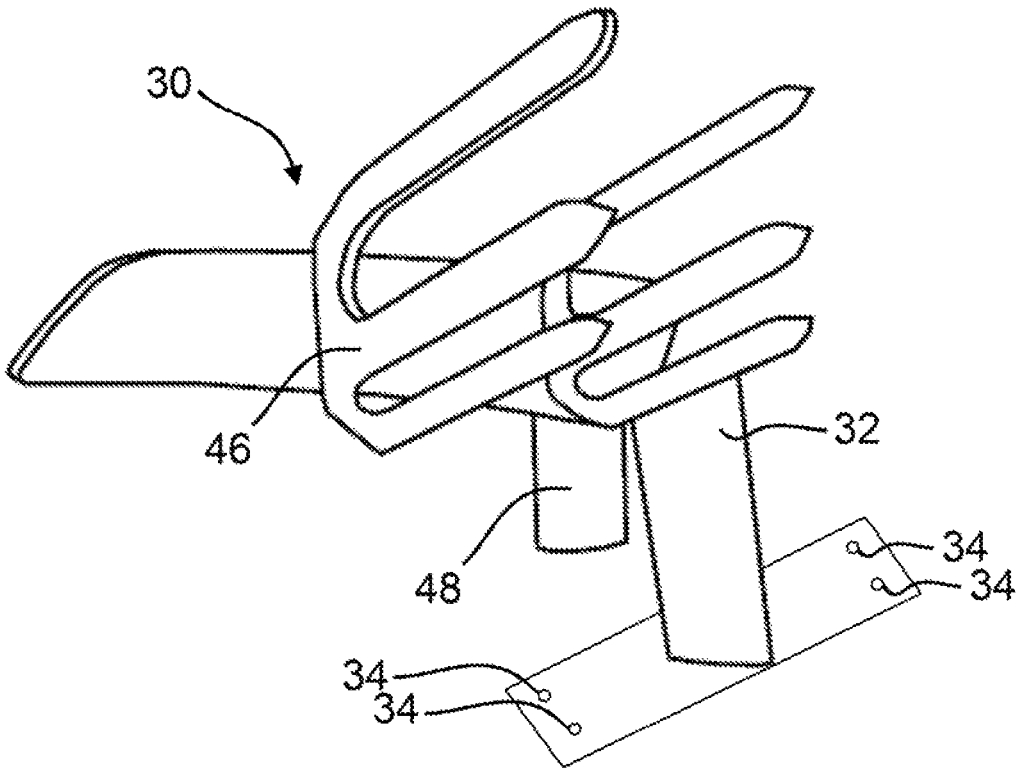
FIG. 3 is a pictorial representation of the motorized swiveling water sports equipment rack of FIG. 2 in another operating position.

FIG. 1 is a perspective view of a boat 10 having a hull 12 made up of the load or structural bearing portions of the boat, which include a bow 14, a stern 16, a starboard side 18 and a port side 20. Although not shown, the boat 10 can include a tower, such as a wakeboard tower that includes mounting points secured to the starboard side 18 and port side 20 of the boat 10. With most boats the space within the hull 12 of the boat 10 is limited. The interior space within the hull 12 of the boat 10, for purposes of the present application, is referred to herein as the "inside" of the boat 10 and defined for purposes herein as the space between the bow 14, stern 16, starboard side 18 and port side 20. Conversely, exterior space is referred to herein as the space "outside" of the boat 10 and defined herein as the space outside the boat 10 beyond the bow 14, stem 16, starboard side 18 and port side 20. As with most boats, the boat 10 represented pictorially in FIG. 1 includes a helm 24 with one or more controls for operating the boat 10 and other types of equipment aboard the boat 10. The boat 10 can include one or more motorized water sports equipment racks 30 in accordance with the objects, features, or advantages of the invention. The motorized water sports equipment rack 30 is configured to store various types of water sports equipment, such as surf boards, water skis, wake boards, and other like water sports equipment (not shown). The operator controls located at the helm 24 of the boat can include a controller 56 operatively configured for operating a motorized water sports equipment rack 30. A controller can also be configured and located immediately at or on a motorized water sports equipment rack 30 for controlling operation of the motorized water sports equipment rack 30. A main object, feature or advantage of the motorized water sports equipment rack 30 is to provide motored automation of the swiveling movement of a water sports equipment rack 46 whereby the motorized water sports equipment rack 30, upon being actuated, automatically moves between various positions, wherein in at least one position the rack 46 is positioned outside the boat 10 as shown in FIG. 2 and in another position the rack 46 is positioned inside the boat 10 as shown in FIG. 3. The swiveling movement of the motorized water sports equipment rack 30 is preferably actuated by a controller conveniently located at the helm 24 and/or immediately at the motorized water sports equipment rack 30. Although the exemplary illustrations of the invention show the motorized water sports equipment rack 30 mounted at a certain location on the boat 10 (e.g., at the top of the starboard sidewall 22 on the starboard side 18), the invention contemplates mounting the motorized water sports equipment rack 30 at any suitable location on the boat 10. Mounting and implementation locations can include, but are not limited to, the tops of the sidewalls of the bow 14, stern 16, starboard side 18, and port side 20, on a wakeboard tower (not shown), or other locations on the hull 12 of the boat 10.

Focusing now on FIGS. 4-7, the various components of the motorized water sports equipment rack 30 are pictorially illustrated with greater detail. As shown, the motorized water sports equipment rack 30 includes a mounting bracket 32 for securing the motorized water sports equipment rack 30 to a location, as addressed above, on the boat. The mounting bracket 32 can be manufactured from square/round tubing, such as from aluminum, polished aluminum or other like marine rugged and safe materials known in the industry. The mounting bracket 32 can also be fabricated from cast, extruded, 3-d printed, or other billet-type materials. The mounting bracket can be a component independent of any stock components, structure or hardware of the boat 10. In such a case, the mounting bracket 32 can be configured with one or more mounting points 34 for securing the mounting bracket to the boat, a component of the boat or an aftermarket component on the boat. Both stock and aftermarket components on the boat 10 can also be used as a mounting bracket. For example, a stock or aftermarket wakeboard rack (not shown) can be used as a mounting bracket or mounting point for the motorized water sports equipment rack 30. A water sports rack mounting bracket 36 is operatively secured to the mounting bracket 32 or some other mounting point for supporting the motorized water sports equipment rack 30. The water sports rack mounting bracket 36 can be manufactured from a stock of aluminum, polished aluminum or other like marine-rugged and safe materials known in the industry. The water sports rack mounting bracket 36 can also be fabricated from cast, extruded, 3-d printed, or other billet-type materials. The water sports rack mounting bracket 36 is formed with a mounting end 38 operatively secured to the mounting bracket 32. In at least one embodiment, the water sports rack mounting bracket 36 includes one or more bolt holes through which a bolt extends and the threads of which are threadably received within counterpoising threads disposed in the mounting bracket 32. Other securement components for securing the mounting end 38 to the mounting bracket 32 are also contemplated. These components can include, but are not limited to, other fasteners such as pins, screws, detents, latches, welds, etc. The water sports rack mounting bracket also includes a swivel bracket supporting end 40. In one exemplary design, the swivel bracket supporting end 40 includes opposing terminal surfaces, such as a top surface and a bottom surface having one or more bolt holes through which one or more bolts, pins, shafts or like hardware extend for operatively securing the swivel bracket supporting end 40 to the swivel bracket 42. In a preferred configuration, the swivel bracket 42 is designed and configured to swivel about the water sports rack mounting bracket 36 whereby the swivel action of the swivel bracket 42 is carried by the swivel bracket supporting end 40 of the water sports rack mounting bracket 36. The swivel bracket 42 is a generally "U" shaped bracket. The swivel bracket 42 can be manufactured from a stock material, such as from aluminum, polished aluminum or other like marine-rugged and safe materials known in the industry. The swivel bracket 42 can also be fabricated from cast, extruded, 3-d printed, or other billet-type materials. Each leg of the bracket 42 includes a hole that, when the swivel bracket and mounting bolt are assembled, aligns with the holes in the swivel bracket supporting end 40 of the water sports rack mounting bracket 36. Securement means extend through the holes operatively mating the swivel bracket 42 to the water sports rack mounting bracket 36. In one exemplary design, a bolt 58 operatively secures the top leg of the swivel bracket 42 with the top surface of the swivel bracket supporting end 40 of the water sports rack mounting bracket 36. Similarly, a drive shaft 52 extends through and operatively secures the bottom leg of the swivel bracket 42 to the bottom surface of the swivel bracket supporting end 40 of the water sports rack mounting bracket 36. Alternatively, a bolt, pin or other securement means can extend through and operatively secure the bottom leg of the swivel bracket 42 to the bottom surface of the swivel bracket supporting end 40 of the water sports rack mounting bracket 36. The end of the shaft received within the bottom leg of the swivel bracket 42 can be secured to the water sports rack mounting bracket 36 by a pin (e.g., a locking or cross pin). A locking or cross pin prevents the drive shaft 52 from spinning within the water sports rack mounting bracket 36 whereby rotation of the drive shaft (discussed later herein) imparts rotation to the swivel bracket 42. With this configuration the swivel bracket 42 can swivel about the water sports rack mounting bracket 36 by rotating the drive shaft 52.

The swivel bracket 42 is free to rotate/swivel about the water sports rack mounting bracket 36, preferably under operation of an actuator 50 powered electrically, pneumatically or hydraulically. With these types of actuators there is some amount of creep that occurs, particularly as a result of torque and weight acting on the swivel bracket 42. Aspects of the invention contemplating configuring one or more stops, brakes, or pin locks into the motorized water sports equipment rack 30. In one example, the actuator 50 could be configured to have both locked and unlocked states, whereby the actuator permits movement of the swivel bracket 42 in the unlocked state and prohibits movement of the swivel bracket 42 in the locked state. A locking mechanism configured with one or more components, such as, but not limited to, a pin, detent, collar, spring, gear, tab, slide, rib, channel, bearing, guide, brake, sleeve, and/or retainer to prohibit and permit rotation of the swivel bracket 42. One or more of these components can be configured as a locking system of the motorized water sports equipment rack 30. A locking system can be configured as part of the actuator 50, a drive system operably configured between the actuator 50 and the swivel bracket 42, the swivel bracket 42, the water sports rack mounting bracket 36, the mounting bracket 32 or any other component(s) of the motorized water sports equipment rack 30. For example, a locking system (not shown) could be configured into the motorized water sports equipment rack 30 to lock movement of the swivel bracket in an "out" position and an "in" position, or any position there between. A locking system or mechanism can be configured to be operably actuated by a controller conveniently located at the helm 24 and/or immediately at the motorized water sports equipment rack 30. A locking system can be electrically, pneumatically or hydraulically actuated to lock and unlock movement of the motorized water sports equipment rack 30. A locking system can also include one or more levers, handles or like members for manually locking and unlocking movement of the motorized water sports equipment rack 30.

Figure 4:
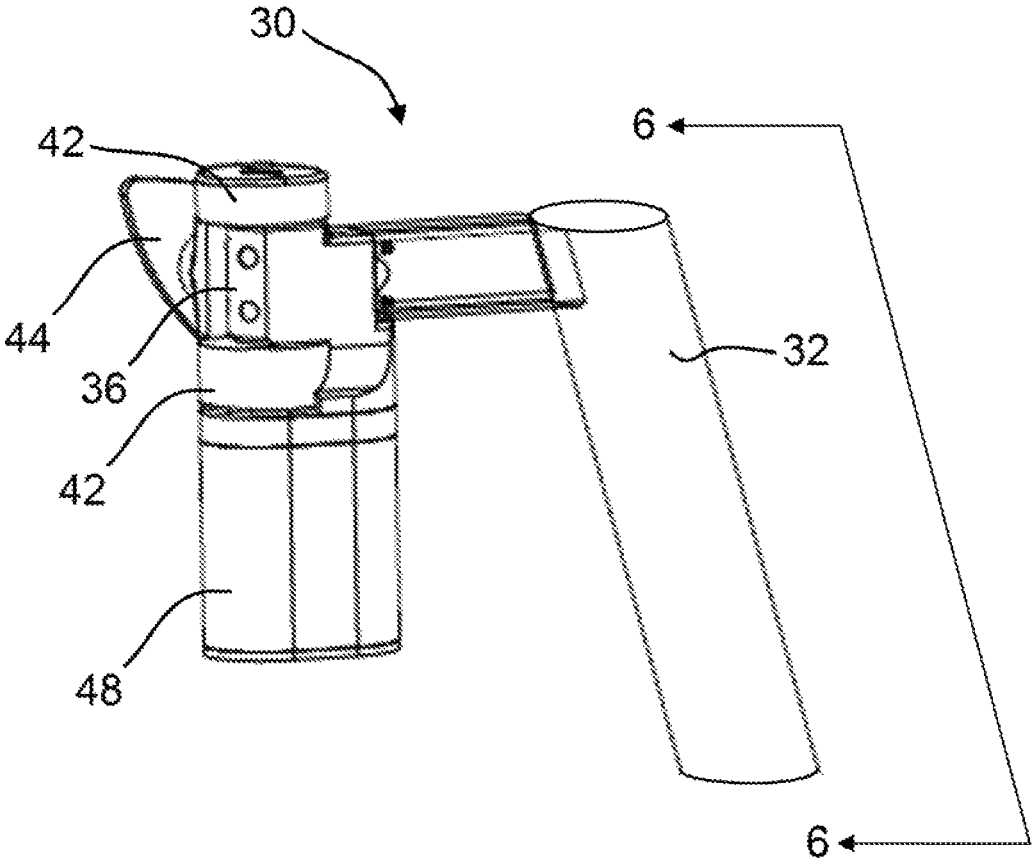
FIG. 4 is a pictorial representation showing a detailed view of the motorized swiveling water sports equipment rack shown in FIGS. 1-3.
Figure 5:
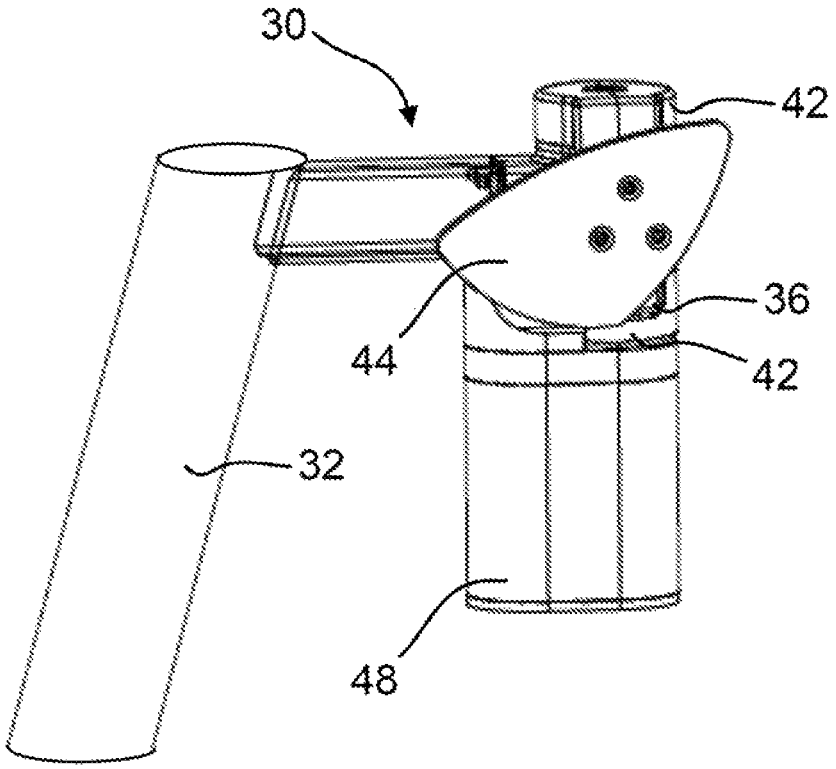
FIG. 5 is a pictorial representation showing another detailed view of the motorized swiveling sports equipment rack shown in FIG. 4.
Figure 6:
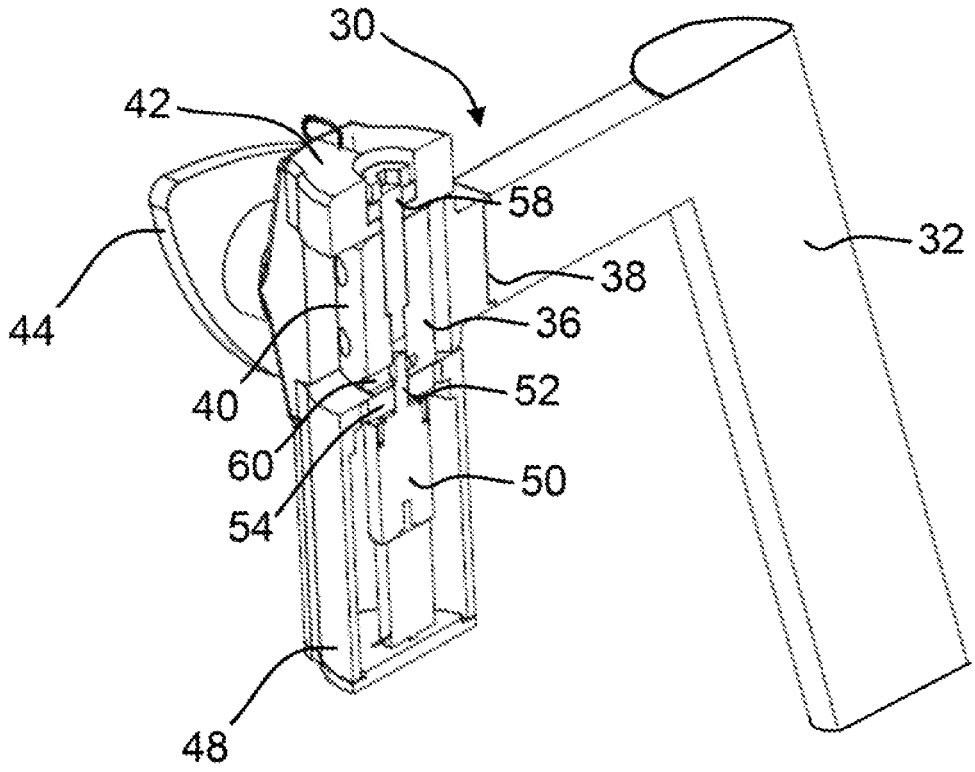
FIG. 6 is a cross-sectional view taken along line 6-6 in FIG. 5.
Figure 7:
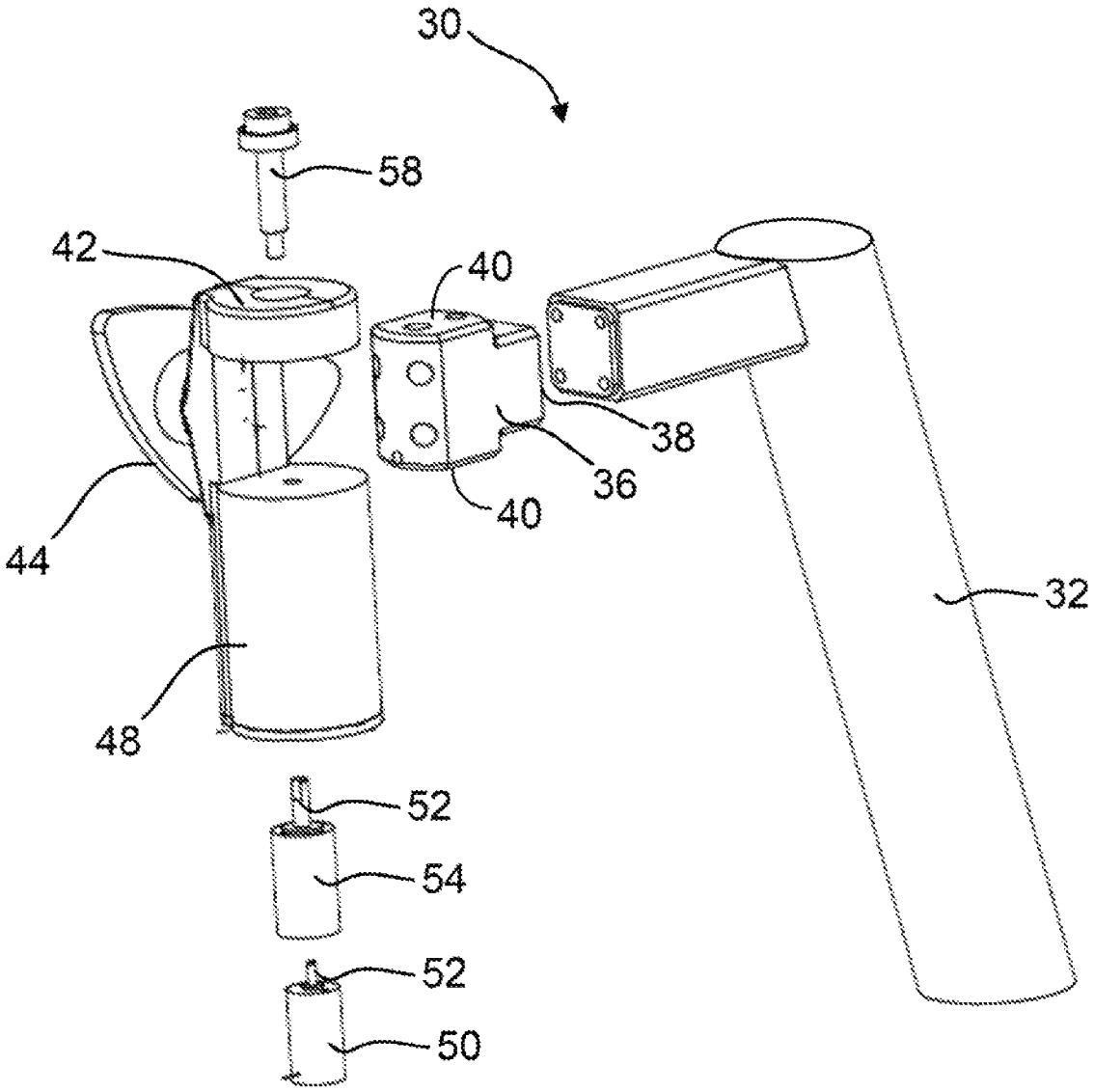
FIG. 7 is a pictorial representation of an exploded view of the motorized swiveling water sports equipment rack.

The swivel bracket 42 can be configured to include an actuator housing 48 that houses an actuator 50, such as a DC motor, a pneumatic motor or a hydraulic motor. The actuator housing 48 can be manufactured from a stock of aluminum, polished aluminum or other like marine-rugged and safe materials known in the industry. The actuator housing 48 can also be fabricated from cast, extruded, 3-d printed, or other billet-type materials. The drive shaft 52 is driven by the actuator 50, which imparts a swivel motion to both the swivel bracket 42 and actuator housing 48. Thus, as shown in FIG. 4, the water sports rack mount 32 rotates and shares a common axis of rotation 43 about both the water sports rack mounting bracket 36 and the actuator housing 48 to rotate the water sports equipment rack mount 32 and the water sports equipment rack. Alternatively, the drive shaft is operatively connected to a gearbox 5, 4 which is operatively connected and driven by the actuator 50. The gearbox 54 can be configured to stepdown the RPM from the actuator to a suitable RPM for the drive shaft 52. The gearbox can be include one or more interoperative gears, whereby one or more of the gears are actuated or rotated by the actuator 50 to effect rotation of the motorized water sports equipment rack 30. Alternatively, one or more pistons, levers, or arms can be actuated by the actuator 50 to effect rotation of the motorized water sports equipment rack 30. A gearbox 54 makes it possible to use actuators that require a smaller footprint to thereby fit within the smaller confines of the actuator housing 48. Openings, apertures or ports in the actuator housing 48 can be sealed using one or more gaskets, grommets, or seals. One or more weep holes can also be configured in the actuator housing 48 to the interior of the actuator housing 48 to breathe and to allow moisture accumulation to weep from the housing. The actuator 50 is electrically connected to a power source (not shown). The power source can be the electrical system of the boat 10 or a separate 24V, 12V or 6V system operably configured with one or more batteries. In the case of multiple batteries, a parallel or series configuration can be used to control the output voltage to the motorized water sports equipment rack 30. The power source can be configured as a deep cycle battery bank for marine applications. Each configuration has benefits in the marine environment and are contemplated herein as a power source for the motorized water sports equipment rack 30. The actuator 50 can be operably configured to be powered by the electrical system of the boat 10 or a separate 24V, 12V or 6V system operably configured with one or more batteries. The actuator 50 can be operated using a controller 56, located at the helm 24 or at the motorized water sports equipment rack 30. In some embodiments the controller 56 may be built into or integrated with the control system of the boat.

An actuator 50 is housed within the actuator housing 48. The actuator can be electric, pneumatic or hydraulic. A power source for the actuator 50 can be operably connected to an electrical, pneumatic or hydraulic system of the boat 10. Alternatively, an electrical, pneumatic or hydraulic source for powering the actuator 50 can be operably configured as a component of the motorized water sports equipment rack 30.

According to another design, the water sports rack mounting bracket 36 can be configured to include the actuator housing 48 with the actuator 50. Again, the actuator housing 48 can be manufactured from a stock of aluminum, polished aluminum or other like marine-rugged and safe materials known in the industry. The actuator housing 48 can also be fabricated from cast, extruded, 3-d printed, or other billet-type materials. The drive shaft 52 is driven by the actuator 50, which imparts a swivel motion to the swivel bracket 42. With this design, the actuator housing 48 does not swivel with the swivel bracket 42. Alternatively, the drive shaft is operatively connected to a gearbox 54, which is operatively connected and driven by the actuator 50. The gearbox 54 can be configured to stepdown the RPM from the actuator to a suitable RPM for the drive shaft 52. The gearbox can be include one or more interoperative gears, whereby one or more of the gears are actuated or rotated by the actuator 50 to effect rotation of the motorized water sports equipment rack 30. Alternatively, one or more pistons, levers, or arms can be actuated by the actuator 50 to effect rotation of the motorized water sports equipment rack 30. A gearbox 54 makes it possible to use actuators that require a smaller footprint to thereby fit within the smaller confines of the actuator housing 48. Openings, apertures or ports in the actuator housing 48 can be sealed using one or more gaskets, grommets, or seals. One or more weep holes can also be configured in the actuator housing 48 to allow the interior of the actuator housing 48 to breathe and to allow moisture accumulation to weep from of the housing. The actuator 50 is electrically connected to a power source (not shown). The power source can be the electrical system of the boat 10 or a separate 24V, 12V or 6V system operably configured with one or more batteries. In the case of multiple batteries, a parallel or series configuration can be used to control the output voltage to the motorized water sports equipment rack 30. The power source can be configured as a deep cycle battery bank for marine applications. Each configuration has benefits in the marine environment and are contemplated herein as a power source for the motorized water sports equipment rack 30. The actuator 50 can be operably configured to be powered by the electrical system of the boat 10 or a separate 24 V, 12V or 6V system operably configured with one or more batteries. The actuator 50 can be operated using a controller 56, located at the helm 24 or at the motorized water sports equipment rack 30. The actuator can be electric, pneumatic or hydraulic. A power source for the actuator 50 can be operably connected to an electrical, pneumatic or hydraulic system of the boat 10. Alternatively, an electrical, pneumatic or hydraulic source for powering the actuator 50 can be operably configured as a component of the motorized water sports equipment rack 30.

A rack mount 44 is operatively secured to the swivel bracket 42 and swivels with the swivel bracket 42. The rack mount 44 is operatively configured to carry a rack 46, such as a commercially available wakeboard rack. The rack 46 is designed to removably store one or more types of water sports equipment, such as surf boards, water skis, wakeboards, and other water sports equipment.

In operation, the motorized water sports equipment rack 30 swivels automatically upon receiving a control signal from the controller 56. The motorized water sports equipment rack 30 can be configured to rotate the rack 46 in either the xy or yz plane of a three-dimensional Cartesian coordinate system. The motorized water sports equipment rack 30 can be configured to rotate up to 270 degrees, but in most configurations rotates around 180 degrees providing the requisite movement for swiveling the rack 46 between positions inside and outside the boat 10. Water sports equipment (not shown) stored in the rack 46 can be, by motorized actuation of the motorized water sports equipment rack 30, swiveled to a position outside the boat 10 to increase the available space inside the boat 10, swiveled to a position inside the boat 10 to increase the available space outside the boat 10, or swiveled to some position in between to accommodate space requirements both inside and outside the boat 10. The captain of the boat 10 can operate/control the motorized water sports equipment rack 30 from the helm 24 and/or immediately at the motorized water sports equipment rack 30. Given the motorized, automated, controller-operated functionality of the motorized water sports equipment rack 30, all the objects, features and advantages of the invention are achieved. The following provides some non-limiting examples of a few, but not all of the objects, features and advantages realized by the motorized water sports equipment rack 30.

Example 1

The motorized, automated, controller-operated functionality of the motorized water sports equipment rack 30 has many benefits. First, many boat owners store their boats on the water in their own personal boat slip. A slip with a roof has support poles which are usually very close to the opening of a boat slip where a captain must navigate the boat into a tight space. When a boater stores their watersports equipment in the racks 46, and the racks 46 are swiveled outward, the waters ports equipment can catch on the support poles, causing damage to the equipment, damage to the storage racks, damage to the slip support poles, or all of the aforementioned. It can be easy for boaters or the captain of the boat to forget that the storage racks 46 are still in the outward position when pulling into a boat slip. Pulling into a slip also requires a high level of concentration and focus on the captain's part as well. Pulling in and out of a slip is often a task that is performed with nobody else in the boat. When a captain of a vessel is pulling into a s lip, and notices at the last moment that all of the waters ports equipment is stored in the "out" position or outside the boat 10, and will hit the support poles of a dock if the equipment is not swiveled to the "in" position or inside the boat 10, the captain must stop the boat, leave the helm, swivel the racks inward manually (sometimes up to 4 or more separate racks), and resume the task of pulling the boat into the slip. The motorized, automated, controller-operated functionality of the motorized water sports equipment rack 30 allows the captain to automatically swivel the racks 46 inside of the boat, which eliminates time otherwise wasted operating the racks manually and also increases safety by allowing the captain to remain in the helm of the boat 10 the entire time and stay focused on operating/driving the boat 10. Benefits of the motorized, automated, controller-operated functionality of the motorized water sports equipment rack 30 also allows passengers on the boat to concentrate on tying the boat up, keeping the boat from rubbing against the dock, and making sure there's no other dangers when pulling into a slip.

Example 2

Another instance where the motorized, automated, controller-operated functionality of the motorized water sports equipment rack 30 is useful, is when a boater is tying up, or "rafting" with another group of boaters. "Rafting" is when multiple boats will tie their boats together in a long line while anchored. When boaters are rafting, they are navigating their boats in very tight areas, many times with people in the water around them. This is another instance when the captain must remain as focused as possible, and having the captain remain in his/her seat, and being able to swivel the racks 46 automatically increases operational convenience and safety. Automating this process also allows for passengers of the boat to concentrate on other tasks which are required when rafting, such as setting an anchor, tossing ropes to other boats in the raft, attaching fenders to the boat, keeping from bumping into other boats, watching for swimmers, and so on. The motorized, automated, controller-operated functionality of the motorized water sports equipment rack 30 is also highly beneficial to boaters who trailer their boat, and store them in garages, sheds, or other covered areas which may not be wide enough to fit a boat into without swiveling the racks 46 inside the boat 10. If a person is backing the boat 10 into a storage garage, and notices that the racks are in the "out" position or outside the boat 10, the driver of the vehicle can, by operation of a remote controller 56, automatically swivel the racks 46 to the "in" position or inside the boat 10 without ever leaving the driver seat of the tow vehicle. The motorized, automated, controller-operated functionality of the motorized water sports equipment rack 30 thus provides increased convenience and safety by providing automated swiveling of the racks 46.

The invention is not to be limited to the particular embodiments described herein. In particular, the invention contemplates numerous variations in the type of ways in which embodiments of the invention can be applied to the motorized, automated, controller-operated functionality of the motorized water sports equipment rack 30. The foregoing description has been presented for purposes of illustration and description. It is not intended to be an exhaustive list or limit any of the invention to the precise forms disclosed. It is contemplated that other alternatives or exemplary aspects are considered included in the invention. The description is merely examples of embodiments, processes or methods of the invention. It is understood that any other modifications, substitutions, and/or additions can be made, which are within the intended spirit and scope of the invention. For the foregoing, it can be seen that the invention accomplishes at least all of its intended objects, features and advantages.

The previous detailed description is of a small number of embodiments for implementing the invention and is not intended to be limiting in scope. The following claims set forth a number of the inventions of the disclosure disclosed with greater particularity.

What is claimed is:

1. A motorized water sports equipment rack for a boat, comprising:

a mounting bracket having one or more mounting points for securing the mounting bracket to the boat;

a water sports rack mounting bracket having a mounting end connected to the mounting bracket and swivel bracket supporting end;

a swivel bracket operatively connected to the swivel bracket supporting end of the water sports rack mounting bracket, wherein the swivel bracket rotates about the water sports rack mounting bracket;

a water sports equipment rack mount operatively connected to the swivel bracket, wherein the water sports equipment rack mount is configured to support a water sports equipment rack adapted for holding one or more types of water sports equipment;

an actuator operatively connected to the swivel bracket for rotating the water sports equipment rack mount about the water sports rack mounting bracket;

wherein the actuator is positioned for rotating the water sports equipment rack mount about the water sports rack mounting bracket in a generally horizontal plane.

2. The motorized water sports equipment rack of claim 1 wherein the swivel bracket has at least a first position corresponding to an operation of the actuator, wherein the water sports equipment rack is positioned generally inside the boat in the first position of the swivel bracket.

3. The motorized water sports equipment rack of claim 2 wherein the swivel bracket has at least a second position corresponding to another operation of the actuator, wherein the water sports equipment rack is positioned generally outside the boat in the second position of the swivel bracket.

4. The motorized water sports equipment rack of claim 1 further comprising:

a gearbox housed, wherein the gearbox is operatively connected to a drive shaft of the actuator.

5. The motorized water sports equipment rack of claim 1 further comprising:

a controller having a user-control interface in controller operation of the actuator, wherein the controller is operatively mounted at the motorized water sports equipment rack.

6. The method of claim 1 wherein the water sporting equipment is non-motorized water sporting equipment.

7. The method of claim 1 wherein the actuator is positioned for rotating the water sports equipment rack mount about the water sports rack mounting bracket around a generally vertical axis or rotation.

8. A motorized water sports equipment rack for a boat, comprising:

a mounting bracket having one or more mounting points for securing the mounting bracket to the boat;

a water sports rack mounting bracket having a mounting end connected to the mounting bracket and swivel bracket supporting end;

a swivel bracket operatively connected to the swivel bracket supporting end of the water sports rack mounting bracket, wherein the swivel bracket rotates about the water sports rack mounting bracket;

a water sports equipment rack mount operatively connected to the swivel bracket, wherein the water sports equipment rack mount is configured to support a water sports equipment rack adapted for holding one or more types of water sports equipment;

an actuator operatively connected to the swivel bracket for rotating the water sports equipment rack mount about the water sports rack mounting bracket; and a controller having a user-control interface in controller operation of the actuator, wherein the controller is operatively mounted at a helm of the boat.

9. The method of claim 8 wherein the actuator is positioned for rotating the water sports equipment rack mount about the water sports rack mounting bracket in a generally horizontal plane.

10. A boat comprising:

a helm and a hull having structural portions including at least a bow, a stern, and starboard and port sides; and a motorized water sports equipment rack for holding one or more types of water sporting equipment on the boat, the motorized water sports equipment rack including:

a mounting bracket having one or more mounting points for securing the mounting bracket to the boat;

a rack mounting bracket having a mounting end connected to the mounting bracket and a swivel bracket supporting end;

a swivel bracket operatively connected to the swivel bracket supporting end of the rack mounting bracket;

a rack mount operatively connected to the swivel bracket, wherein the rack mount is configured to support a water sports equipment rack adapted for holding the one or more types of water sporting equipment;

a motor; and a drive shaft operatively connected between the motor and the rack mounting bracket;

wherein the motor is configured to rotate the swivel bracket around the rack mounting bracket to rotate the water sports equipment rack between first and second positions;

wherein the motor is positioned for rotating the water sports equipment rack mount about the water sports rack mounting bracket in a generally horizontal plane.

11. The boat of claim 10 wherein the swivel bracket has at least a first position, wherein the water sports equipment rack is positioned generally inside the hull of the boat in the first position of the swivel bracket.

12. The boat of claim 10 wherein swivel bracket has at least a second position wherein the water sports equipment rack is positioned generally outside the hull of the boat in the second position of the swivel bracket.

13. The boat of claim 10 further comprising:

a gearbox housed, wherein the gearbox is operatively connected to the drive shaft of the motor.

14. The boat of claim 10 wherein the mounting bracket of the motorized water sports equipment rack is operatively secured to one of the structural portions of the boat.

15. The boat of claim 10 wherein the water sporting equipment is non-motorized water sporting equipment.

16. The boat of claim 10 wherein the motor is positioned for rotating the water sports equipment rack mount about the water sports rack mounting bracket around a generally vertical axis of rotation.

17. A boat comprising:

a helm and a hull having structural portions including at least a bow, a stern, and starboard and port sides; and a motorized water sports equipment rack for holding one or more types of water sporting equipment on the boat, the motorized water sports equipment rack including:

a mounting bracket having one or more mounting points for securing the mounting bracket to the boat;

a rack mounting bracket having a mounting end connected to the mounting bracket and a swivel bracket supporting end;

a swivel bracket operatively connected to the swivel bracket supporting end of the rack mounting bracket;

a rack mount operatively connected to the swivel bracket, wherein the rack mount is configured to support a water sports equipment rack adapted for holding the one or more types of water sporting equipment;

a motor;

a drive shaft operatively connected between the motor and the rack mounting bracket; and a tower operatively connected to the hull of the boat, wherein the mounting bracket of the motorized water sports equipment rack is operatively secured to the tower;

wherein the motor is configured to rotate the swivel bracket around the rack mounting bracket to rotate the water sports equipment rack between first and second positions.

18. The boat of claim 17 wherein the motor is positioned for rotating the water sports equipment rack mount about the water sports rack mounting bracket in a generally horizontal plane.

19. A boat comprising:

a helm and a hull having structural portions including at least a bow, a stern, and starboard and port sides; and a water sports equipment rack for holding one or more types of water sporting equipment on the boat, the water sports equipment rack including:

a mounting bracket having one or more mounting points for securing the mounting bracket to the boat;

a rack mounting bracket having a mounting end connected to the mounting bracket and a swivel bracket supporting end;

a swivel bracket operatively connected to the swivel bracket supporting end of the rack mounting bracket;

a rack mount operatively connected to the swivel bracket, wherein the rack mount is configured to support a water sports equipment rack adapted for holding the one or more types of water sporting equipment;

an actuator; and a drive shaft operatively connected between the motor and the rack mounting bracket;

wherein the actuator is configured to rotate the swivel bracket in a generally vertical axis of rotation to rotate the water sports equipment rack between first and second positions.

20. The boat of claim 19 further comprising:

a tower operatively connected to the hull of the boat, wherein the mounting bracket of the motorized water sports equipment rack is operatively secured to the tower.

* * * * *